US010301086B2

(12) United States Patent
Minnette et al.

(10) Patent No.: US 10,301,086 B2
(45) **Date of Patent: *May 28, 2019**

(54) CHILD-RESISTANT PACKAGE

(71) Applicant: Berry Plastics Corporation, Evansville, IN (US)

(72) Inventors: Jeffrey C. Minnette, Evansville, IN (US); Ryan P. Davidson, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/873,047

(22) Filed: Jan. 17, 2018

(65) Prior Publication Data

US 2018/0141728 A1 May 24, 2018

Related U.S. Application Data

(63) Continuation of application No. 15/223,553, filed on Jul. 29, 2016, now Pat. No. 9,896,250.

(60) Provisional application No. 62/198,416, filed on Jul. 29, 2015.

(51) Int. Cl.
*B65D 50/04* (2006.01)
*B65D 41/04* (2006.01)

(52) U.S. Cl.
CPC ..... *B65D 50/046* (2013.01); *B65D 41/04* (2013.01); *B65D 2215/02* (2013.01)

(58) Field of Classification Search
CPC .. B65D 50/048; B65D 50/046; B65D 50/045; B65D 1/0246; B65D 1/023; B65D 41/04; B65D 41/0471; B65D 41/0485; B65D 41/06
USPC ... 215/44, 43, 216, 201, 305, 295, 330, 331, 215/329, 316; 220/293, 288, 262
See application file for complete search history.

(56) References Cited

U.S. PATENT DOCUMENTS

| | | | |
|---|---|---|---|
| 3,917,097 | A | 11/1975 | Uhlig |
| 3,989,152 | A | 11/1976 | Julian |
| 5,706,963 | A | 1/1998 | Gargione |
| 5,829,609 | A | 11/1998 | Beck |
| 5,927,527 | A | 7/1999 | Montgomery |
| 6,279,766 | B1 | 8/2001 | Jones |
| 6,729,472 | B2 | 5/2004 | Stucke |
| 2010/0059518 | A1 | 3/2010 | Brozell |
| 2010/0200533 | A1 | 8/2010 | Rice |
| 2015/0175325 | A1 | 6/2015 | Martin |

OTHER PUBLICATIONS

Ex Parte Quayle Action dated May 25, 2017 for U.S. Appl. No. 15/223,553.
Office Action dated Aug. 2, 2017 for U.S. Appl. No. 15/223,553; (pp. 1-10).

*Primary Examiner* — Robert J Hicks
(74) *Attorney, Agent, or Firm* — Barnes & Thornburg LLP

(57) ABSTRACT

A package includes a vessel and a closure. The vessel is formed to include a product-storage chamber and a mouth opening into the product-storage chamber. The closure is configured to mount on the vessel to assume an installed position closing the mouth formed in the vessel when rotated relative to the vessel about a vertical axis of rotation in a closure-installation direction.

20 Claims, 13 Drawing Sheets

CHILD-RESISTANT PACKAGE

PRIORITY CLAIM

This application is a continuation of U.S. patent application Ser. No. 15/223,553, filed Jul. 29, 2016, which claims priority under 35 U.S.C. § 119(e) to U.S. Provisional Application No. 62/198,416, filed Jul. 29, 2015, each of which is expressly incorporated by reference herein.

BACKGROUND

The present disclosure relates to packaging, and particularly to child-resistant packaging. More particularly, the present disclosure relates to child-resistant packaging that includes a closure-release control mechanism used to release a closure from a container.

Child-resistant packaging is used to store products such as cleaning products. To prevent unwanted opening by children, such packaging is often configured to require multiple actions to remove a closure from a companion container.

SUMMARY

According to the present disclosure, a package includes a vessel and a closure. The vessel is formed to include a product-storage chamber and a mouth opening into the product-storage chamber. The closure is configured to mount on the vessel to assume an installed position closing the mouth formed in the vessel when rotated relative to the vessel about a vertical axis of rotation in a clockwise closure-installation direction.

In illustrative embodiments, the vessel includes a container and a container adapter that is formed to include the mouth of the vessel and configured to mate with the closure. The container adapter is a separate item that is mated with the underlying container during a vessel-manufacturing process to form the vessel and define the product-storage chamber of the vessel.

In illustrative embodiments, the package further includes a child-resistant closure-release control mechanism including stationary first and second rotation blockers coupled to a top rim of the container adapter and a multi-mode closure-rotation inhibitor coupled to the closure to rotate therewith during closure installation on and removal from the container adapter. A container adapter in accordance with the present disclosure carries the rotation blockers and may be coupled to an underlying container of any suitable shape.

In illustrative embodiments, the closure-rotation inhibitor may be shifted relative to the container adapter automatically during closure installation and manually during closure removal between a rotation-blocking expanded mode and a rotation-allowing compressed mode. In the rotation-blocking expanded mode, the closure-rotation inhibitor will rotate along with the closure to engage one of the stationary first and second rotation blockers at some point during closure installation or removal to block further rotation of the closure relative to the container adapter. In the rotation-allowing compressed mode, the closure-rotation inhibitor has changed shape to assume a slimmed-down shape that is sized to pass through a space provided between a rotation blocker and the rotatable closure without engaging that companion rotation blocker so that further rotation of the closure relative to the container adapter is allowed leading to removal of the closure from the container adapter.

In illustrative embodiments, the package further includes an external dual-start thread system coupled to a filler neck of the vessel. The external dual-start thread system permits installation of the closure on the vessel by rotating the closure 180 degrees relative to the vessel. In illustrative embodiments, the external dual-start thread system includes first and second threads interleaved with one another. Each thread includes an upper leading edge and a lower trailing edge. The leading edge of each thread is offset 90 degrees from each neighboring rotation blocker.

In illustrative embodiments, the closure-rotation inhibitor comprises an L-shaped compliant arm coupled to the closure and a relatively short curved arm-return spring arranged to interconnect the closure and a free end of the L-shaped compliant arm. The closure-removal inhibitor is made of a flexible resilient plastics material normally to assume the rotation-blocking expanded mode. The closure and the closure-removal inhibitor cooperate to form a monolithic element in which the closure is relatively rigid and the closure-removal inhibitor is flexible to allow the inhibitor to change shape from an expanded shape to a slimmed-down compressed shape and also move relative to the closure during use.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is a perspective view of a child-resistant package in accordance with the present disclosure showing a vessel comprising a container adapter and an underlying container (with a portion of a side wall broken away to show a floor of the container), a rotatable closure mounted on the container adapter to cover a mouth opening into an interior region formed in the vessel, and a closure-release control mechanism comprising upstanding stationary first and second rotation blockers coupled to a top rim of the container adapter and a closure-removal inhibitor coupled to the closure to rotate therewith relative to the container adapter and configured to flex (when cammed or pushed) to shift relative to the container adapter between a normal rotation-blocking expanded mode shown in FIGS. 1, 2, 13, and 14 and a temporary rotation-allowing compressed mode shown in FIG. 12 and showing that the closure-removal inhibitor is configured to include (1) an arm-return spring tethered at an inner end thereof to the closure and (2) a compliant arm coupled at one end to an outer end of the closure and at an opposite end to the arm-return spring;

FIG. 2 is a top plan view of the package of FIG. 1 showing that the rotatable closure is arranged to lie between and in spaced-apart relation to each of the upstanding stationary first and second removal blockers that are coupled to the top rim of the container adapter to provide a radially extending arm-passage space therebetween through which the compliant arm and the arm-return spring may pass when the closure-removal inhibitor is temporarily in the rotation-allowing compressed mode during installation of the closure on the container adapter as suggested in FIG. 12;

FIG. 3 is a side elevation view of the package of FIGS. 1 and 2 showing that an arm-passage space is provided between an outer side wall of the rotatable closure and each of the stationary first and second rotation blockers that are mounted on the top rim of the container adapter;

FIG. 4 is an exploded perspective assembly view showing the closure after it has been separated from the container adapter and positioned to lie above a threaded filler neck that is included in the container adapter and coupled to an inner edge of the top rim of the container adapter and showing that a root end of the compliant arm of the closure-removal inhibitor is coupled to an exterior side wall of the closure and a free end of the compliant arm of the closure-removal inhibitor is coupled to an outer end of the curved arm-return spring that is also included in the closure-removal inhibitor;

Figure 1:
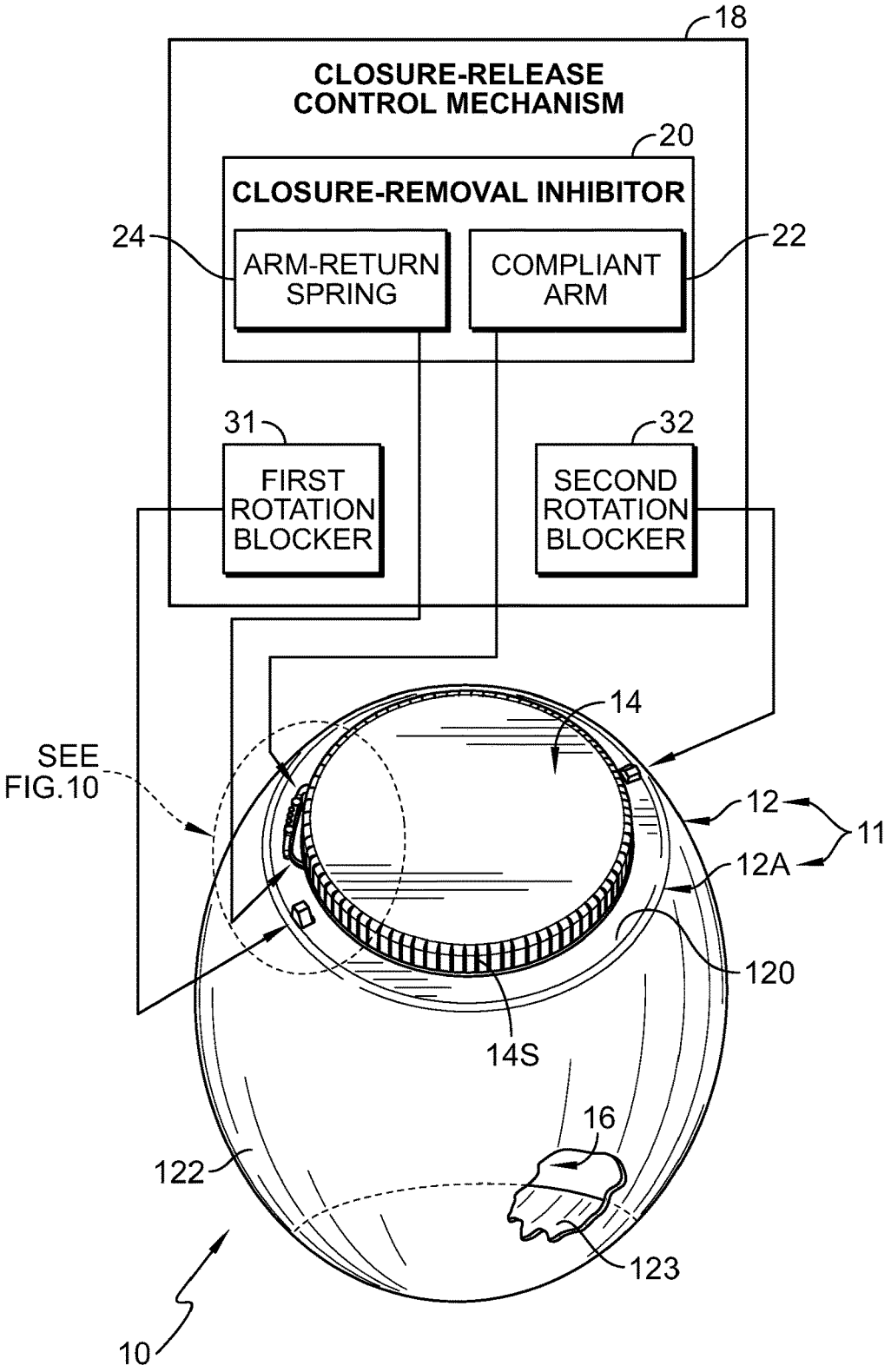
Figure 9:
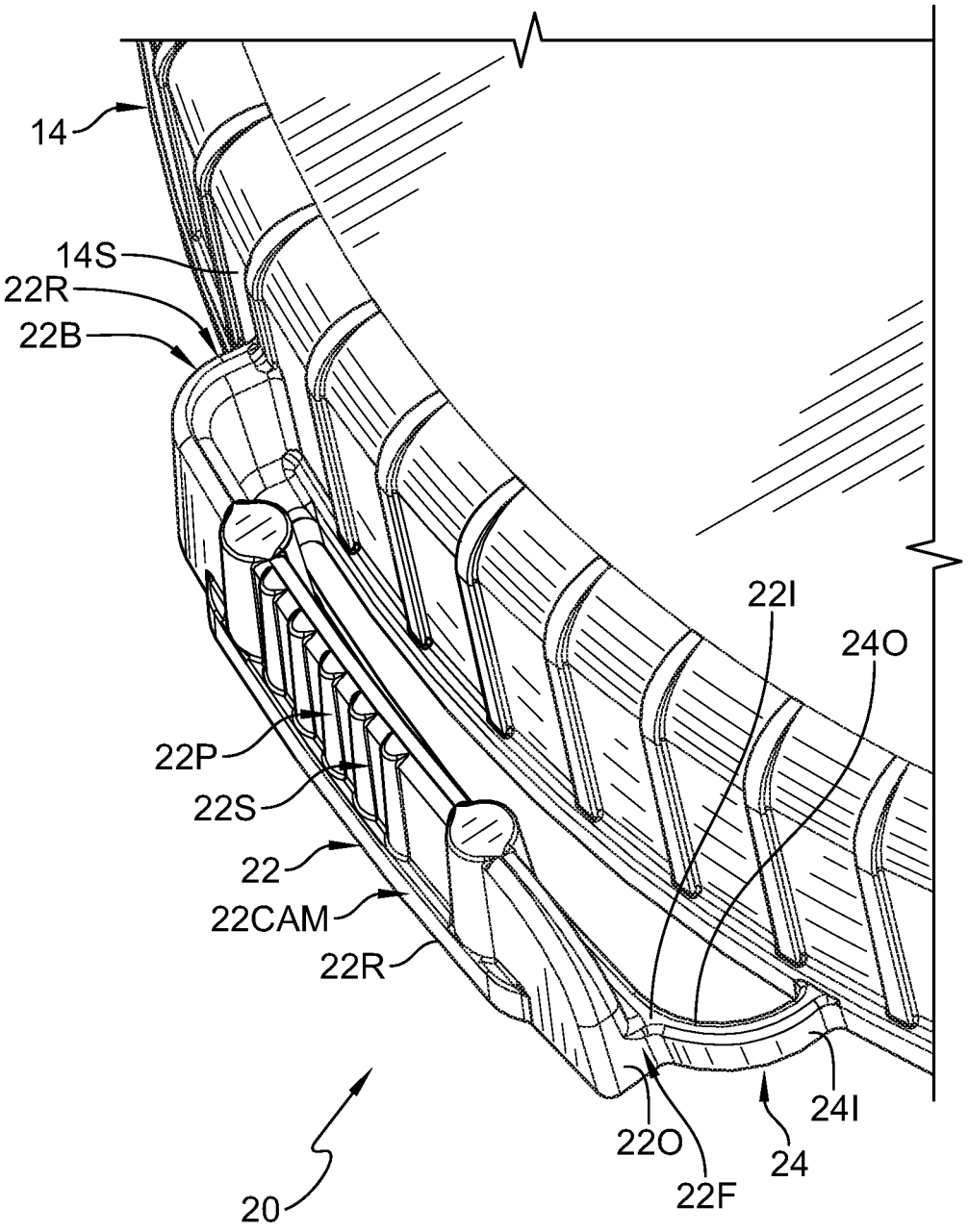
Figure 10:
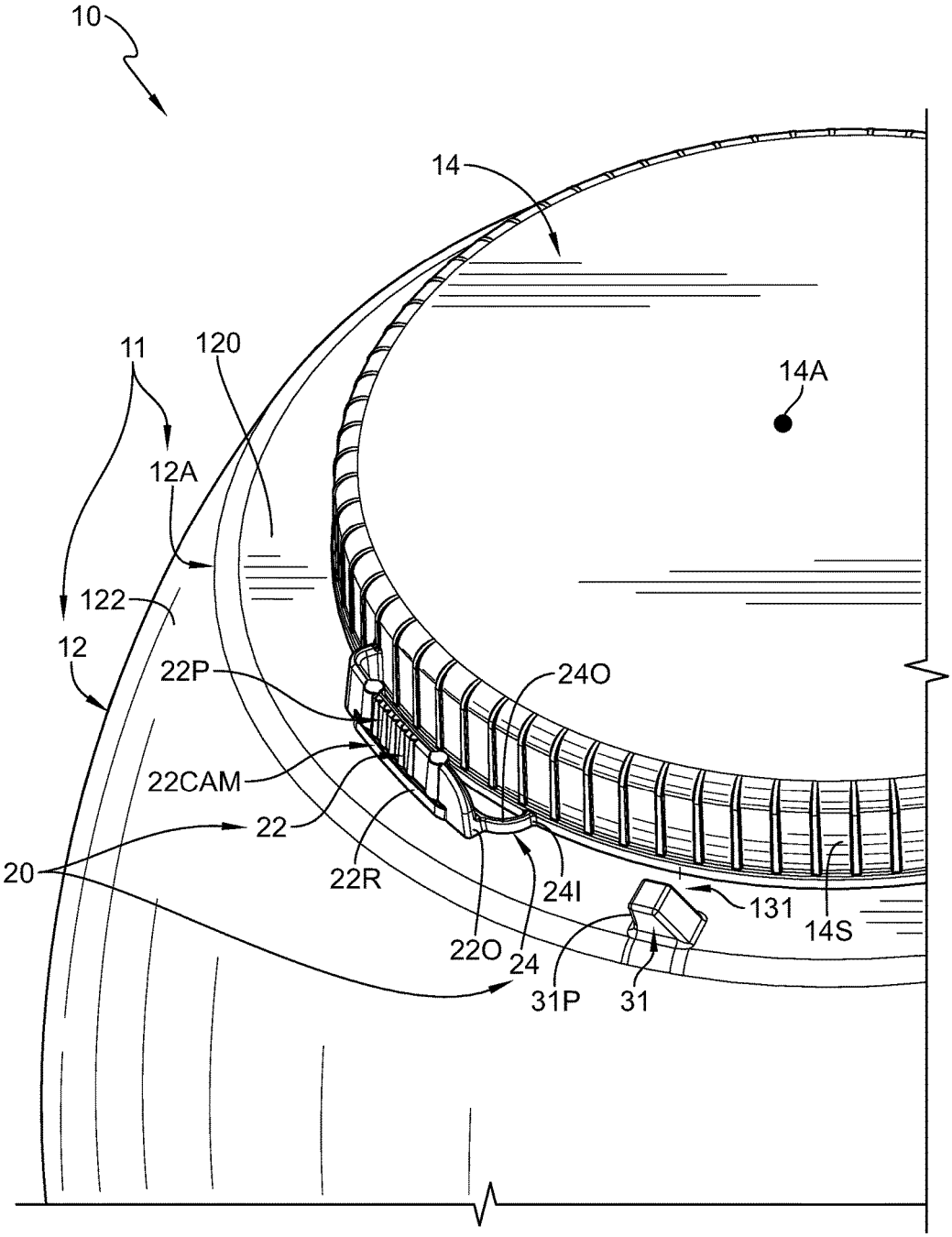
Figure 11:
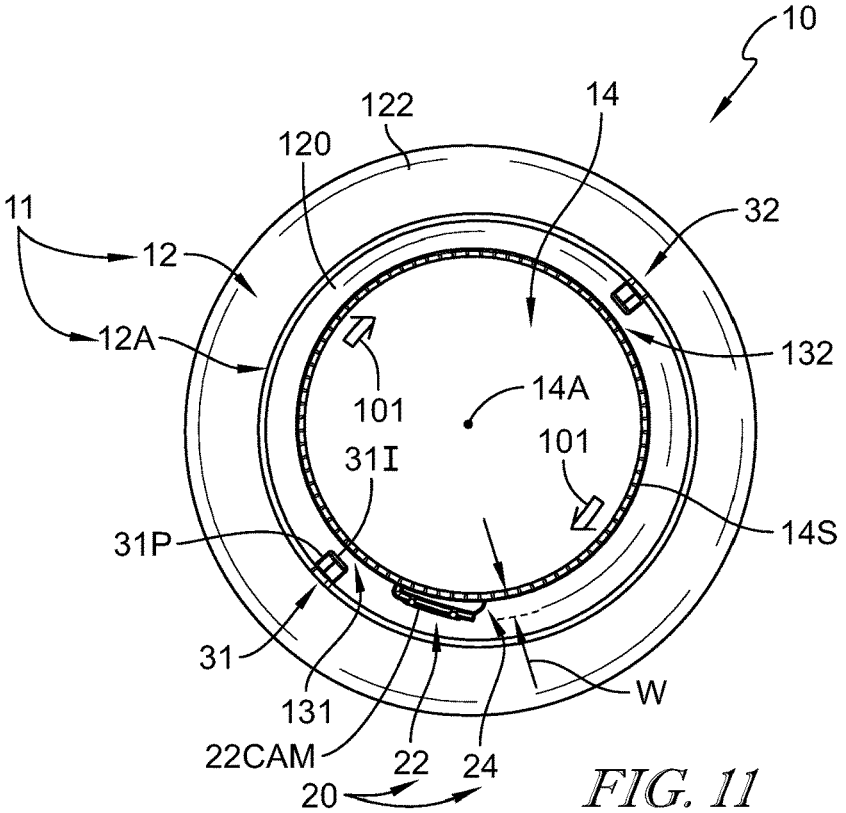
Figure 12:
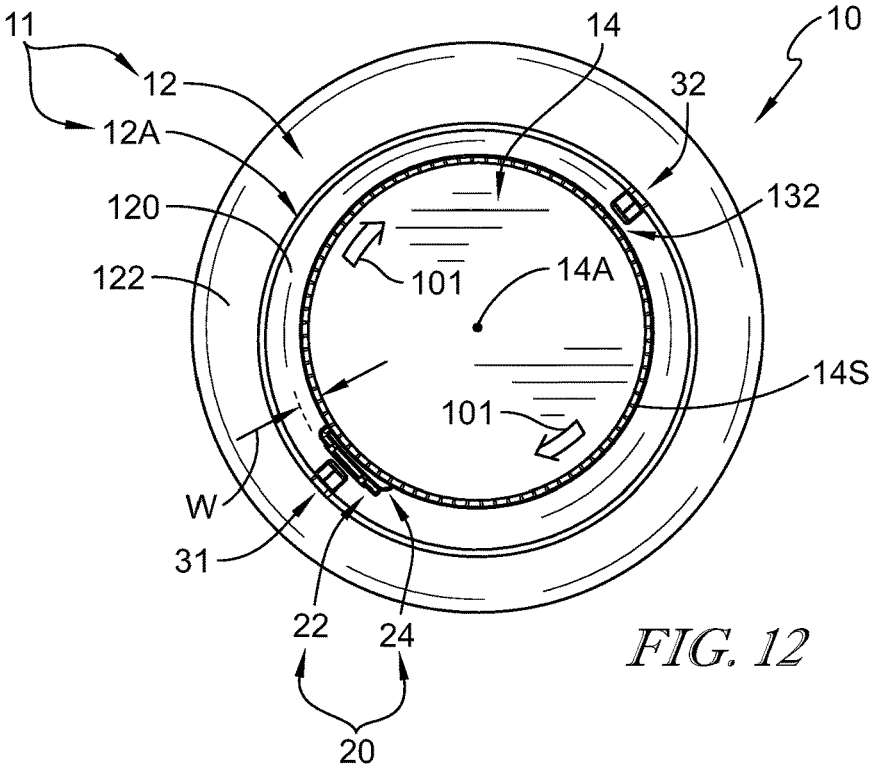
Figure 13:
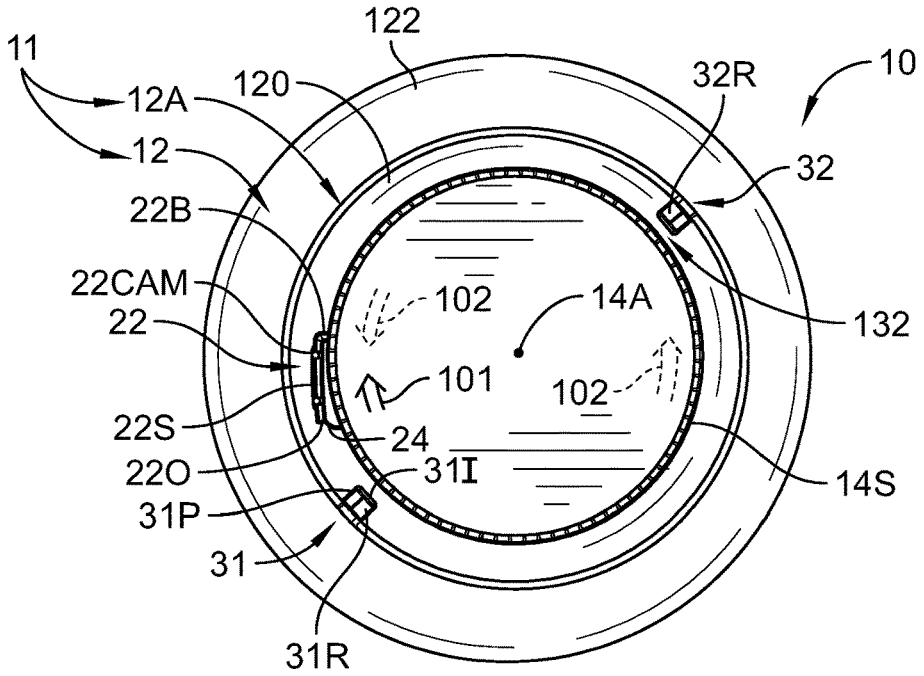
Figure 14:
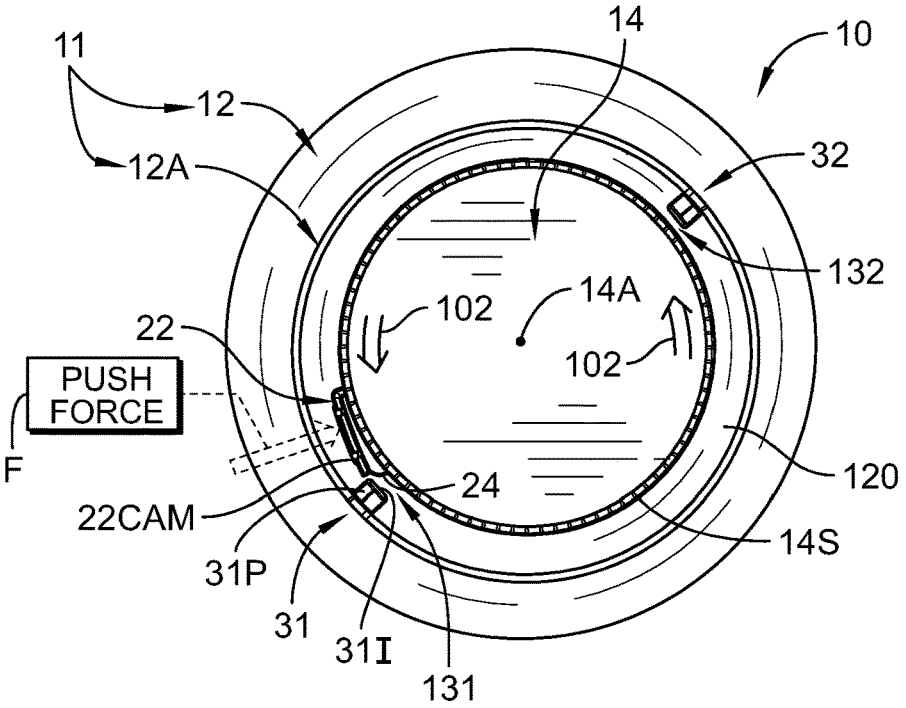
Figure 15:
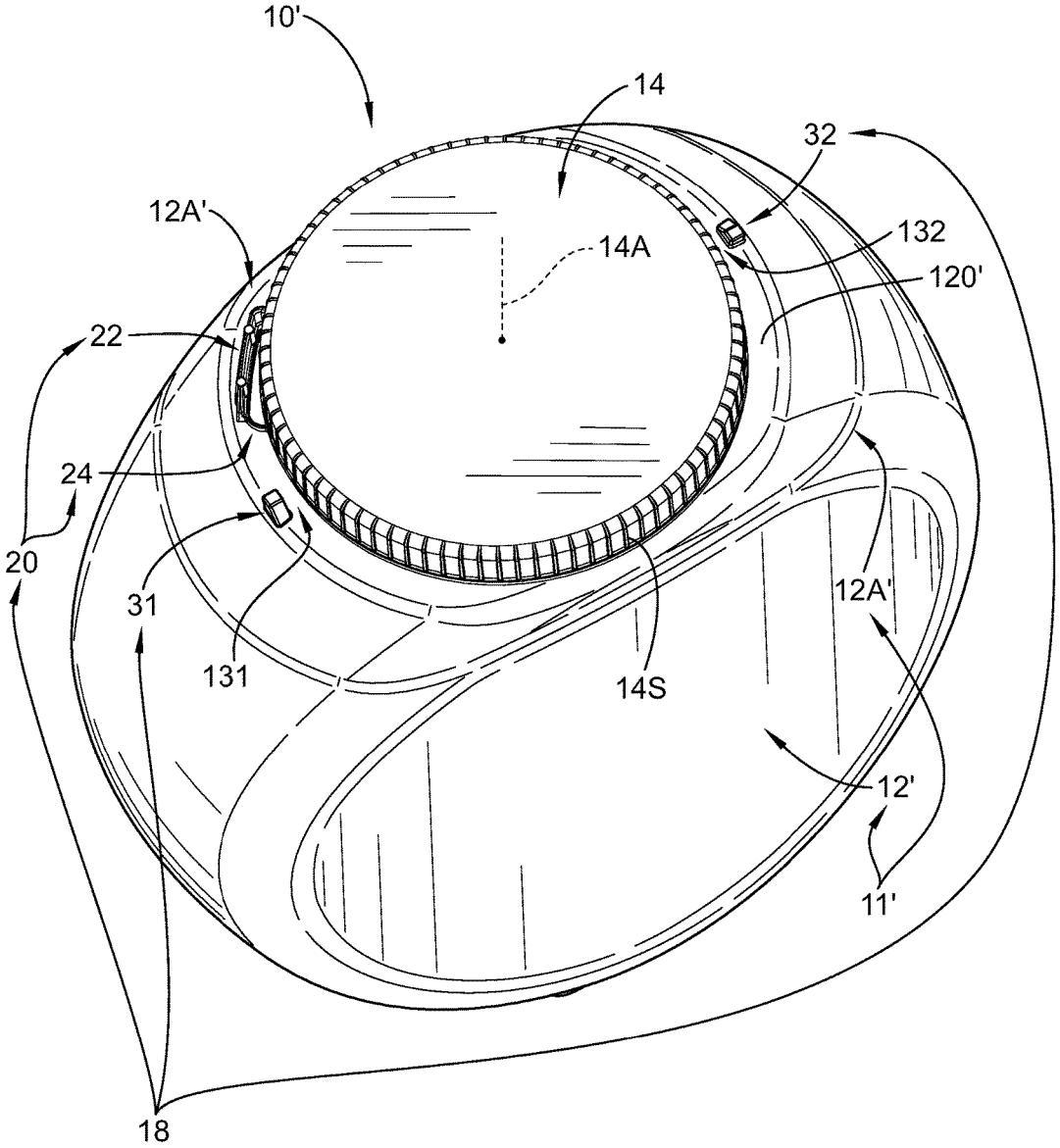
Figure 15A:
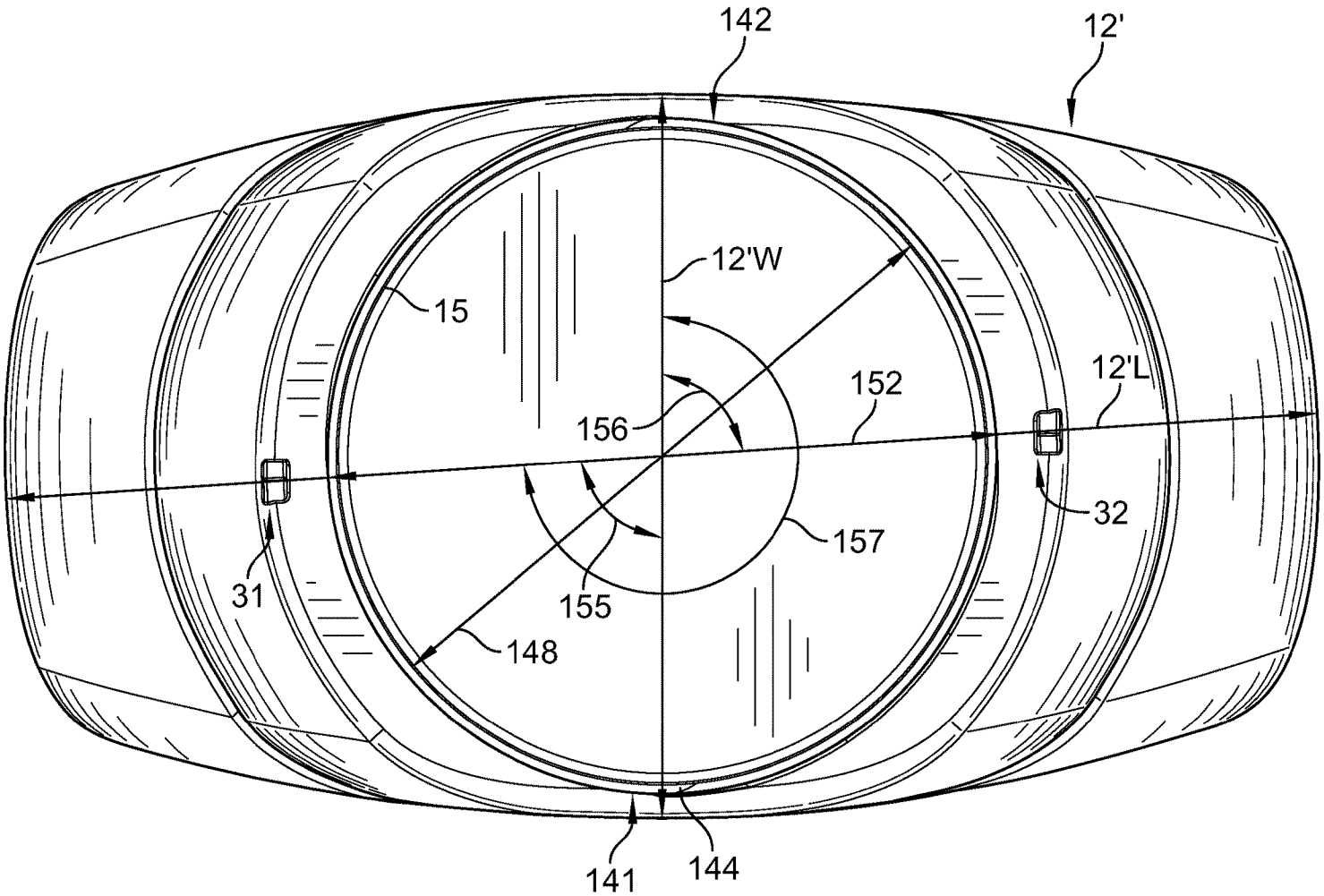
Figure 16:
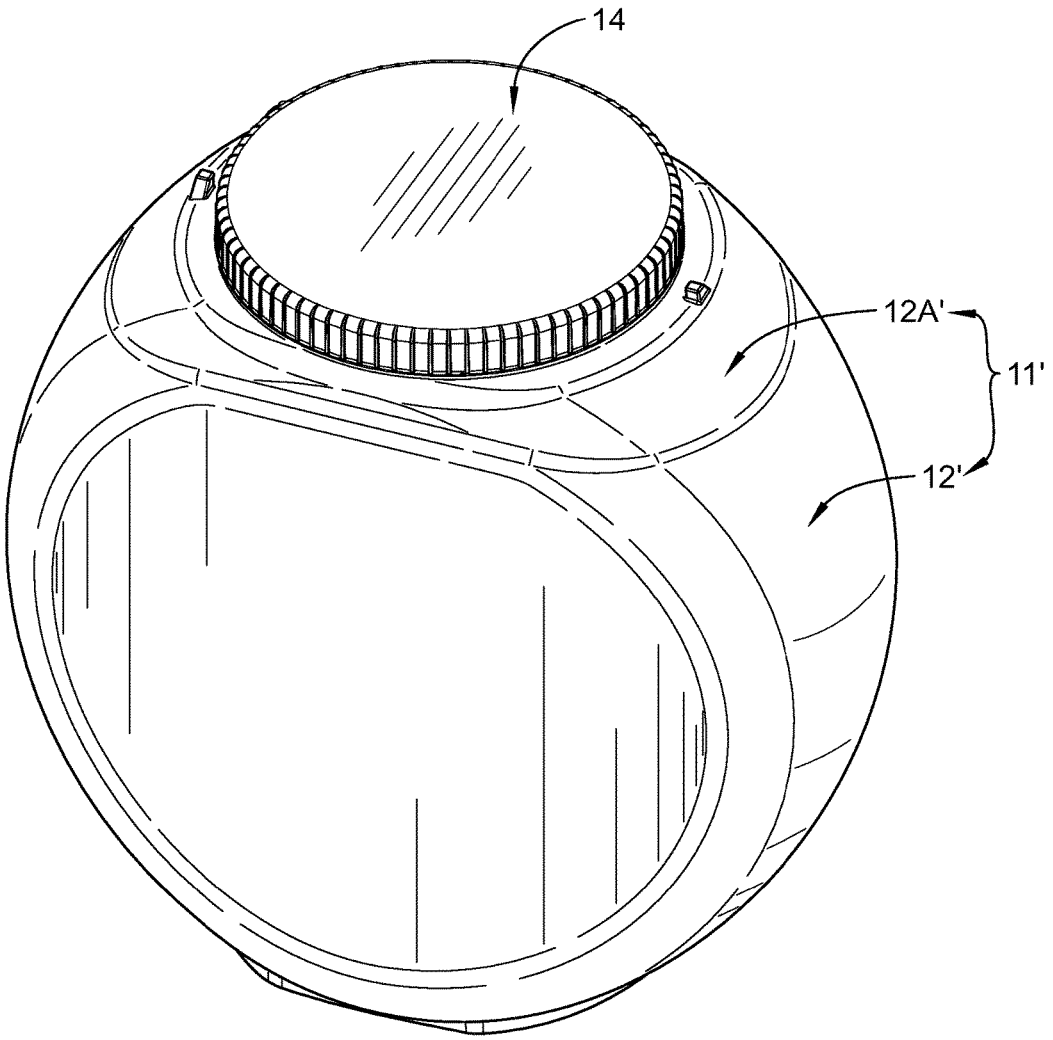
Figure 17:
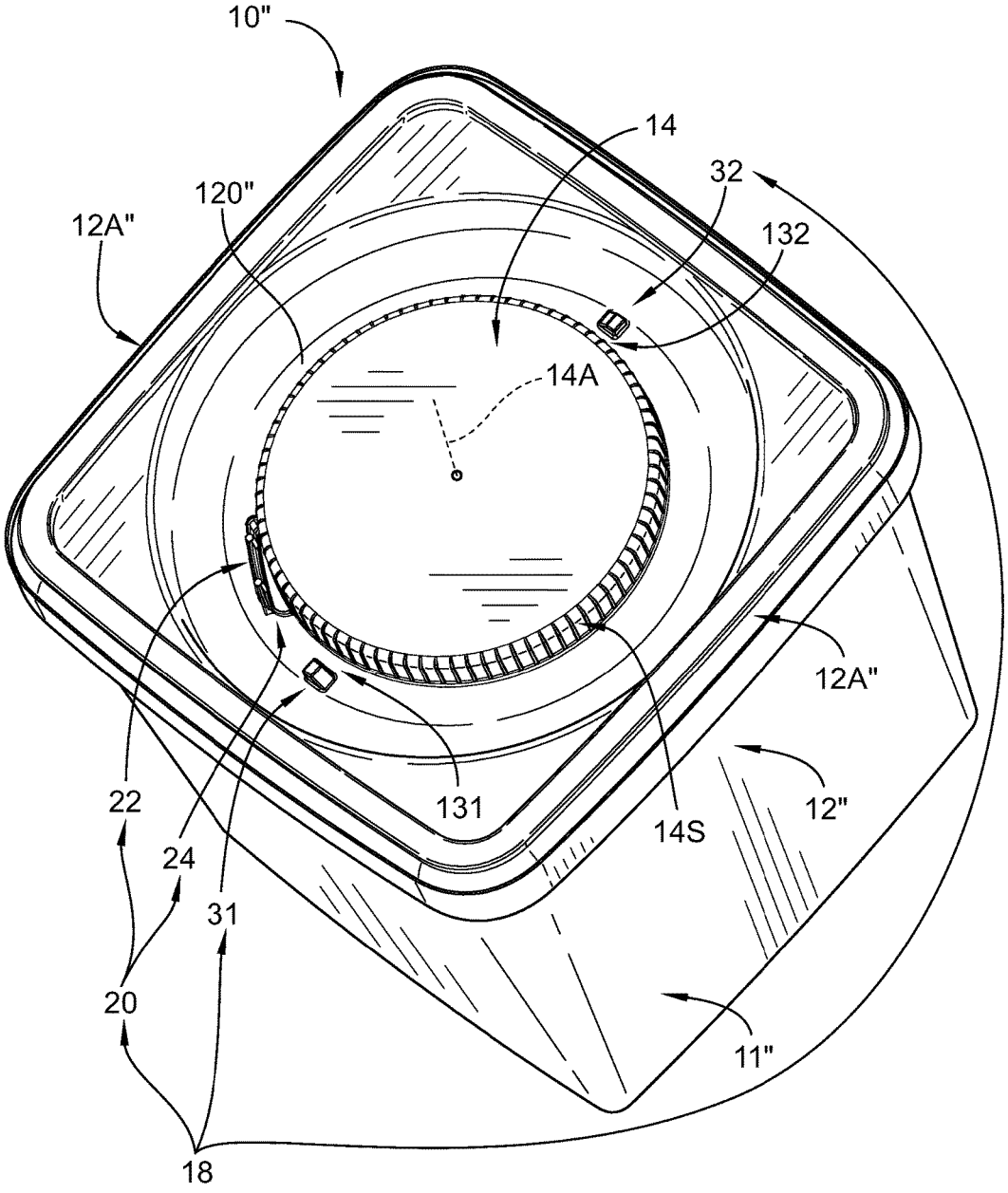
Figure 18:
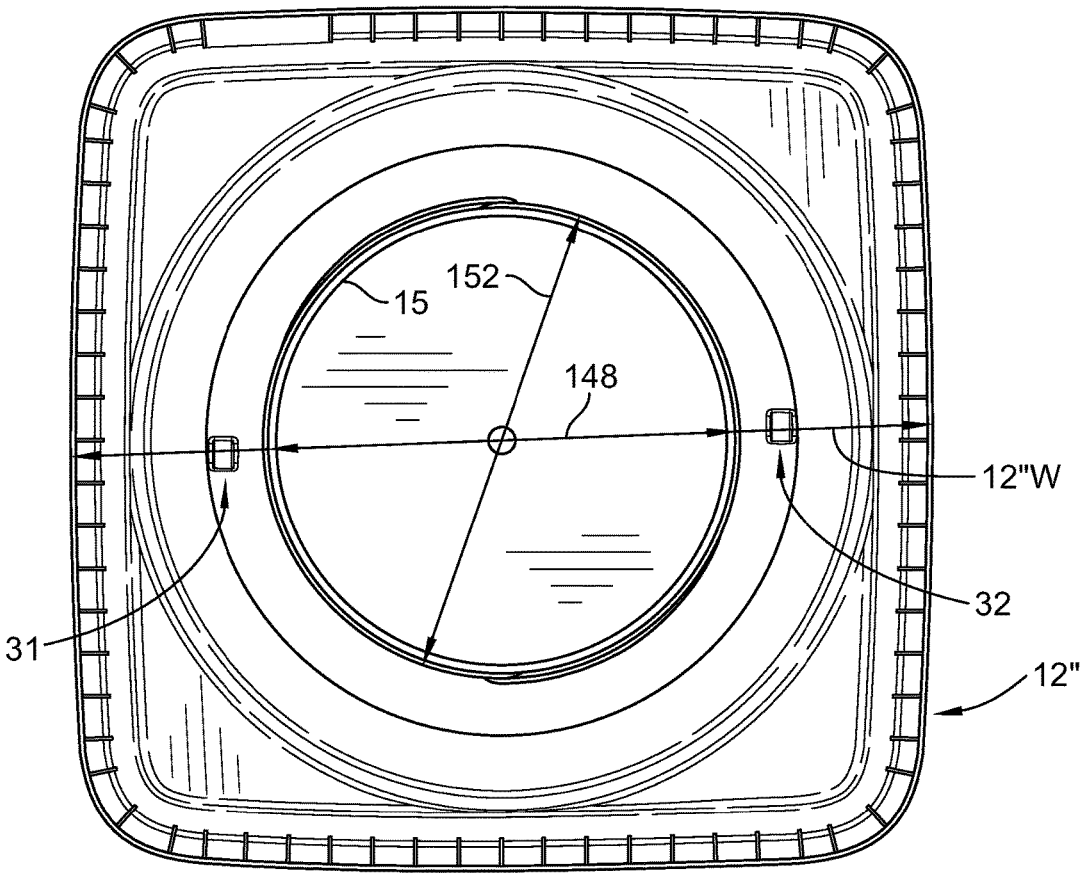

FIG. 9 is an enlarged perspective view of the closure-removal inhibitor of FIGS. 1-7 coupled to an exterior side wall of the closure and showing that the arm-return spring is curved in a natural pre-loaded state and that the compliant arm includes a strip-support base cantilevered to the exterior side wall of the closure and a deflectable strip coupled to the strip-support base and configured to include a free end having (1) a radially inner portion coupled to an outer end of the curved arm-return spring and (2) a radially outer portion configured to provide a stop face;

FIG. 10 is an enlarged view of the circled region of FIG. 1 showing that the stop face of the compliant arm is facing toward a substantially vertical rotation-blocking panel of the first rotation blocker so that the stop face will engage the stationary rotation-blocking panel during counterclockwise rotation of the closure relative to the container adapter to block further rotation of the closure about a vertical closure-rotation axis in a counterclockwise closure-removal direction and thereby inhibit removal of the closure from the container adapter until the deflectable strip of the compliant arm has been pushed to move radially inwardly toward the closure by a user to compress the arm-return spring and cause the compliant arm to flex and move toward and alongside the exterior side wall of the closure as suggested in FIG. 12 so as to move the stop face of the compliant arm into and through the first arm-passage space to avoid contact with the stationary first rotation blocker and allow continued rotation of the closure in the counterclockwise closure-removal direction;

FIG. 11 is a top plan view of the package of FIG. 1 during installation of the rotatable closure on the underlying container adapter and showing that the closure has been rotated on the threaded filler neck of the container adapter in a clockwise closure-installation direction to position the strip-support base of the compliant arm to lie in a downstream position aligned with and facing toward the first arm-passage space provided between the first rotation blocker and the exterior surface of the closure and showing that the leading strip-support base is narrow enough to pass through the first arm-passage space during rotation of the closure about the closure-rotation axis in the clockwise closure-installation direction;

FIG. 12 is a top plan view similar to FIG. 11 showing that a radially inwardly facing portion of the stationary first rotation blocker has engaged an outwardly facing cam-follower ridge included in the deflectable strip to cause the deflectable strip to be moved toward and alongside the exterior side wall of the closure automatically during continued rotation of the closure in the clockwise closure-installation direction so that the compliant arm is arranged to pass through the first arm-passage space provided between the first rotation blocker and the exterior surface of the closure and showing that the arm-return spring coupled to the closure and to the deflectable strip is compressed to lie closer to the exterior surface of the closure during such passage;

FIG. 13 is a top plan view of the package of FIG. 1 after the closure has been rotated still further in the clockwise closure-installation direction to assume an installed container-closing position to cause the stop face provided on the free end of the compliant arm to lie in spaced-apart relation to the rotation-blocking panel provided on the upstanding stationary first rotation blocker;

FIG. 14 is a top plan view similar to FIG. 13 showing some rotation of the closure in a counterclockwise closure-removal direction to cause the stop face provided on the free end of the compliant arm of the closure-removal inhibitor to lie in closely confronting relation to the rotation-blocking panel provided on the upstanding stationary first rotation blocker so that further rotation of the closure relative to the container adapter in the counterclockwise closure-removal direction is blocked by engagement of the moving stop face and the stationary rotation-blocking panel to block removal of the closure from the container adapter unless a radially inwardly directed PUSH force (shown in phantom) is applied by a user to a radially outwardly facing surface of the compliant arm to cause the compliant arm and the arm-return spring to move in tandem toward the exterior side wall of the closure to assume compressed positions associated with the rotation-allowing compressed mode of the closure-removal inhibitor shown in FIG. 12 to cause the stop face provided on the free end of the compliant arm to move radically inwardly away from the rotation-blocking panel of the stationary first rotation blocker so that continued rotation of the closure about the vertical closure-rotation axis in the counterclockwise closure-removal direction leading to removal of the closure from the container is possible without any engagement of the rotating stop face provided on the free end of the compliant arm and the rotation-blocking panel of the stationary first rotation blocker;

FIG. 15 is a perspective view of another package in accordance with the present disclosure having a vessel that is shaped differently than the vessel shown in FIG. 1;

FIG. 15A is a top plan view of the container of FIG. 15;

FIG. 16 is another view of the package of FIG. 15;

FIG. 17 is a perspective view of yet another package in accordance with the present disclosure having a vessel that is shaped differently than the vessels shown in FIGS. 1 and 15; and FIG. 18 is a top pan view of the container of FIG. 17.

DETAILED DESCRIPTION

A child-resistant package 10 includes a vessel 11 comprising a container 12 and a container adapter 12A as shown in FIG. 1. Child-resistant package 10 also comprises a rotatable closure 14 mounted on container adapter 12A for rotation about a closure-rotation axis 14A to cover a mouth 15 opening into a product-storage chamber 16 formed in vessel 11 as shown in an illustrative embodiment shown, for example, in FIGS. 1-3. Child-resistant package 10 also includes a child-resistant closure-release control mechanism 18 configured to control release of closure 14 from container adapter 12A. A package 10' in accordance with another embodiment of the present disclosure is shown, for example, in FIGS. 15 and 16 and includes a container 12' and container adapter 12A' having a top rim 120'. A package 10" in accordance with yet another embodiment of the present disclosure is shown in FIG. 17 and includes a container 12" and a container adapter 12A" having a top rim 120".

Figure 4:
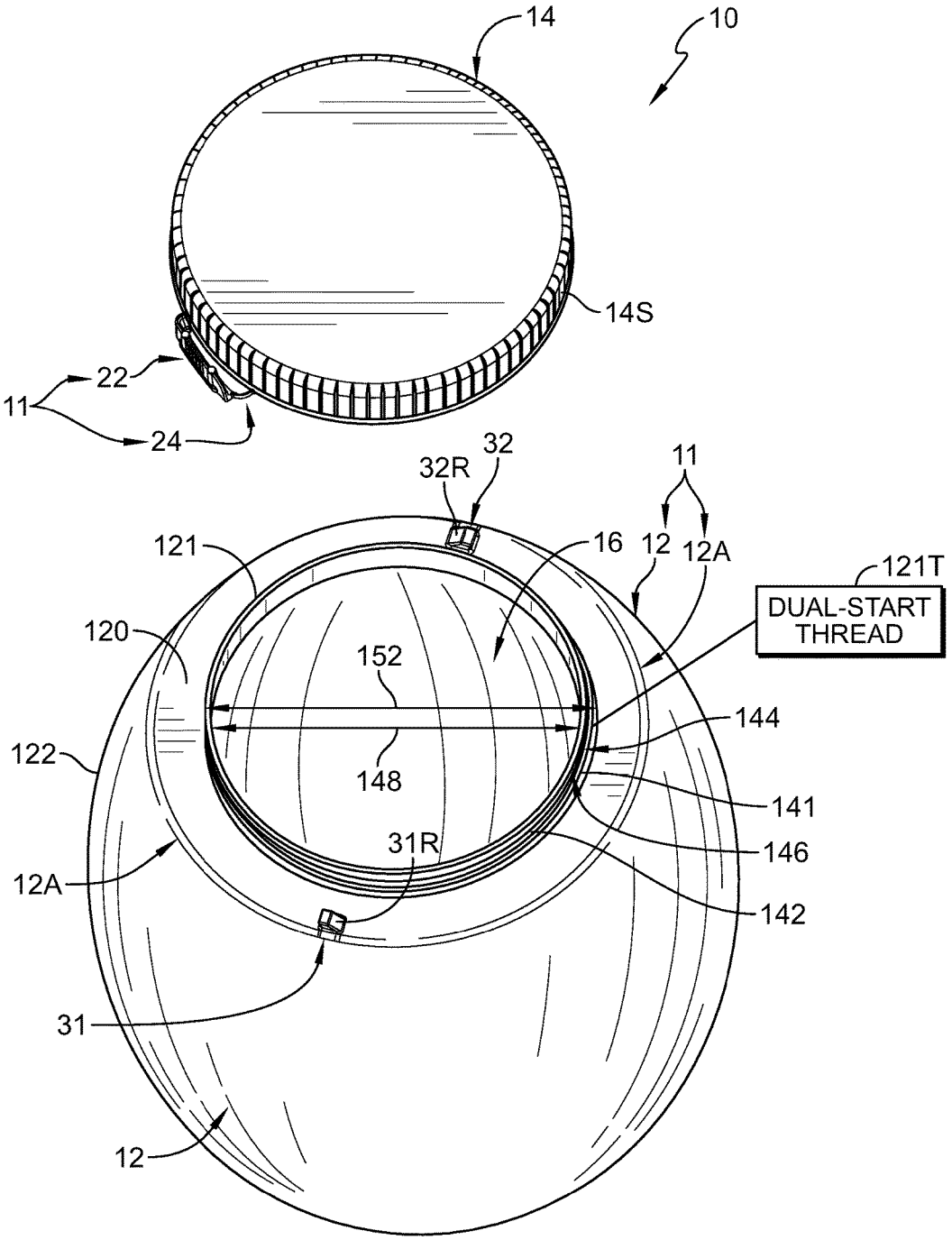

Vessel 11 includes a container 12 and a container adapter 12A as shown, for example, in FIGS. 1 and 4. Container adapter 12A is formed to include the mouth 15 of vessel 11 and is configured to mate with closure 14. Container adapter 12A is a separate molded item that is mated with the underlying container 12 to form vessel 11 and define a product-storage chamber 16 of vessel during a vessel-manufacturing process.

Closure-release control mechanism 18 includes a multi-mode closure-removal inhibitor 20 comprising a compliant arm 22 coupled to closure 14 and an arm-return spring 24 arranged to interconnect closure 14 and a free end 22F of compliant arm 22 as suggested in FIGS. 1, 4, and 9. Compliant arm 22 is able to be moved relative to arm-return spring 24 and to closure 14 during flexure of closure-removal inhibitor 20 as suggested in FIGS. 11 and 12. Closure-removal inhibitor 20 may be shifted relative to container adapter 12A automatically (during closure installation) or manually (during closure removal) between a rotation-blocking expanded mode shown, for example, in FIGS. 1, 2, and 13 and a rotation-allowing compressed mode shown, for example, in FIG. 12. In illustrative embodiments, closure 14, compliant arm 22, and arm-return spring 24 cooperate to form a monolithic component made of a plastics material.

Closure-release control mechanism 18 also includes upright stationary first and second rotation blockers 31, 32 coupled to container adapter 12A as shown, for example, in FIGS. 1, 4, and 11-14. In an illustrative embodiment, each rotation blocker 31, 32 is coupled to a top rim 120 of container adapter 12A. Rotation blockers 31, 32 are arranged to lie in spaced-apart relation to one another to locate the rotatable closure 14 therebetween to provide a first arm-passage space 131 between first rotation blocker 31 and rotatable closure 14 and to provide a second arm-passage space 132 between closure 14 and second rotation blocker 32 as suggested in FIG. 2.

Closure-removal inhibitor 20 may be shifted from the normal rotation-blocking expanded mode to the temporary rotation-allowing mode in accordance with the present disclosure. Compliant arm 22 (and arm-return spring 24) will flex and move relative to closure 14 automatically owing to engagement with radially inwardly facing portions of stationary first rotation blocker 31 to assume a temporary slimmed-down shape so that compliant arm 22 and arm-return spring 24 may pass through first arm-passage space 131 as suggested in FIG. 12 during installation of closure 14 on container adapter 12A compliant arm 22 (and arm-return spring 24) also will flex and move relative to closure 14 only when a radially inwardly directed PUSH force is applied by a knowledgeable user to an exterior side of closure-removal inhibitor 20 as suggested in phantom in FIG. 14 so that compliant arm 22 and arm-return spring 24 may pass in a counterclockwise direction through first arm-passage space 131 (see, for example, FIG. 12).

Figure 2:
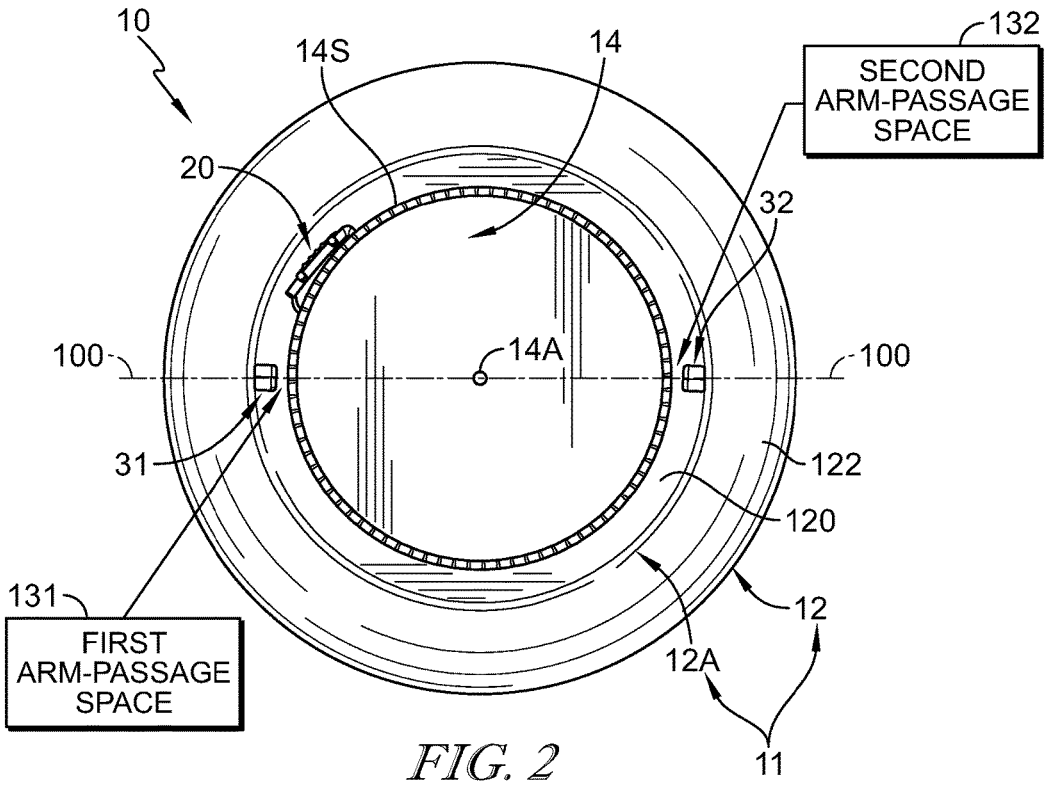
Figure 3:
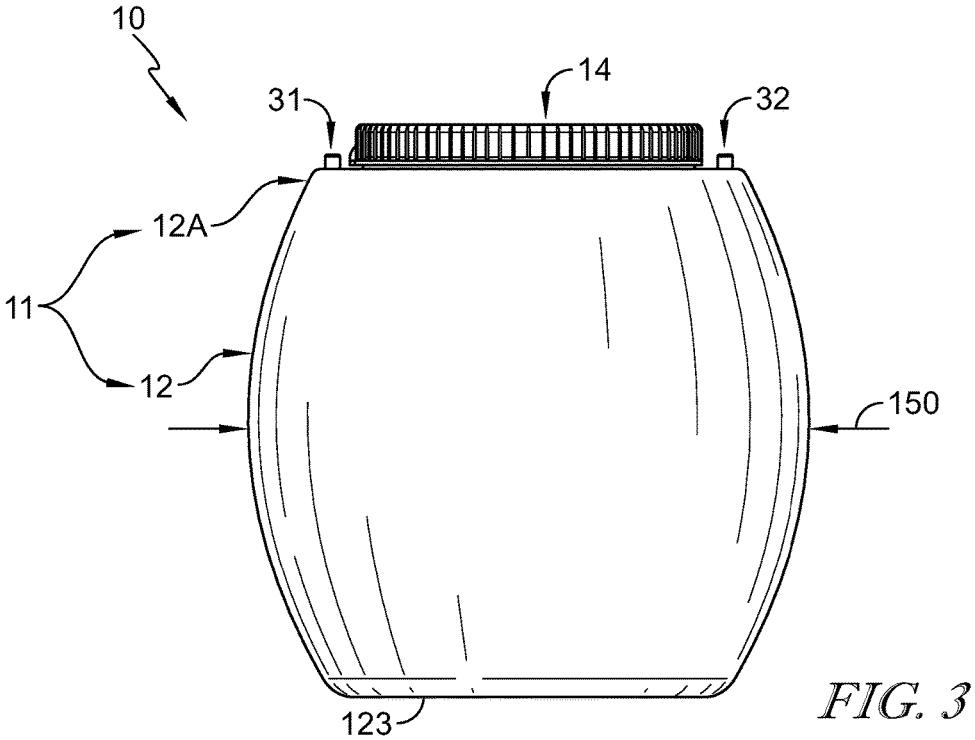

Only one of the stationary first and second rotation blockers 31, 32 included in closure-release control mechanism 18 will be needed to interact with the rotating closure-removal inhibitor 20 during installation of closure 14 on container adapter 12A or removal of closure 14 from container adapter 12A as suggested in FIG. 2. No more than 180° of rotation of closure 14 is required to install closure 14 on container adapter 12A in the embodiment of FIGS. 1-14. If closure 14 is oriented relative to container adapter 12A to position closure-removal inhibitor 20 below the reference line 100 shown in FIG. 2 when closure 14 is first moved downwardly to engage the underlying container adapter 12A during the first stage of a closure-installation process, then only first rotation blocker 31 (and a companion first arm-passage space 131) will be used to control removal of closure 14 from container adapter 12A. However, if closure 14 is oriented relative to container adapter 12A to position closure-removal inhibitor 20 above the reference line 100 shown in FIG. 2 at the start of a closure-installation process, then only second rotation blocker 32 (and a companion second arm-passage space 132) will be used to control removal of closure 14 from container adapter 12A.

Container adapter 12A includes an upwardly extending filler neck 121 coupled to an inner edge of top rim 120 and a downwardly extending side wall 122 coupled to an outer edge of top rim 120 as suggested in FIG. 4. Filler neck 121 includes external threads in an illustrative embodiment to mate with internal threads included in closure 14. Container 12 also includes a floor 123 coupled to a lower edge of side wall 122 and arranged to cooperate with side wall 122 and with top rim 120 and filler neck 121 of container adapter 12A to define the product-storage chamber 16 of vessel 11. Filler neck 121 includes an outer end formed to include mouth 15 as suggested in FIG. 4. While top rim 120 has an annular shape in the embodiment of FIGS. 1-14, it is within the scope of the present disclosure to provide container adapter 12A and vessel 11 with any suitable shape. As an example, a package 10' comprising a vessel 11' including a container adapter 12A' and a container 12', a closure 14, and a closure-release control mechanism 18 is shown in FIGS. 15 and 16. In another example, a package 10" comprising a vessel 11", a container 12" having a box-like shape and a container adapter 12A", a closure 14, and a closure-release control mechanism 18 is shown in FIG. 17.

During installation of rotatable closure 14 on filler neck 121 of container adapter 12A, compliant arm 22 and arm-return spring 24 of closure-removal inhibitor 20 are moved automatically from a normal radially outwardly extending expanded mode shown, for example in FIG. 11, to a temporary radially inwardly extending compressed mode to lie alongside an exterior side wall 14S of closure 14 as shown, for example, in FIG. 12 during rotation of closure 14 about closure-rotation axis 14A in a clockwise closure-installation direction 101. In the expanded mode, closure-removal inhibitor 20 has an expanded width W as suggested in FIG. 11. In the compressed mode, the lateral width of closure-removal inhibitor 20 is reduced from expanded width W to compressed width w as shown, for example, in FIG. 12 due to camming engagement of a radially outwardly facing surface 22CAM on compliant arm 22 with a radially inwardly facing surface 311 on the stationary first rotation blocker 31 to cause each of the compliant arm 22 and arm-return spring 24 to flex and move relative to (and closer to) closure 14 so that closure-removal inhibitor 20 temporarily is slim enough to pass through the first arm-passage space 131 provided between the stationary first rotation blocker 31 and the exterior side wall 14S of closure 14 during rotation of closure 14 in the clockwise closure-installation direction 101 as suggested in FIGS. 11-13. Once the temporarily slimmed-down closure-removal inhibitor 20 passes through the first arm-passage space 131 it will snap back to shift to the normal expanded mode as suggested in FIG. 13 owing to resilient spring characteristics of each of the compliant arm 22 and the arm-return spring 24.

During a first stage of closure removal, closure 14 will be rotated by a user in a counterclockwise closure-removal direction 102 from, for example, an installed position shown in FIG. 13 to a rotation-blocked position in which a stop face 220 of a free end 22F of compliant arm 22 is arranged to face toward and mate with a confronting rotation-blocking panel 31P included in first rotation blocker 31 to block further rotation of closure 14 in the counterclockwise closure-removal direction 102 so that the user is unable to continue to rotate the closure 14 about closure-rotation axis 14A sufficiently to separate closure 14 from the filler neck 121 included in container adapter 12A. A knowledgeable user will know to apply a radially inwardly directed push force F to the radially outwardly facing surface 22P of compliant arm 22 to cause compliant arm 22 and arm-return spring 24 to move (as a unit) toward the exterior side wall 14S of closure 14 to assume the temporary compressed mode. In such a mode, the resilient and flexible closure-removal inhibitor 20 will be slimmed down enough so that it will pass through the first arm-passage space 131 to allow continued rotation of closure 14 about closure-rotation axis 14A in the counterclockwise closure-removal direction 102 until closure 14 may be separated from filler neck 121 of container adapter 12A.

As suggested in FIG. 4, top rim 120 of container adapter 12A has an annular shape. Each of the first and second rotation blockers 31, 32 is coupled to a radially outer portion of annular top rim 120 to lie in close proximity to side wall 122 of container 12. The rotation blockers 31, 32 are arranged to lie diametrically opposed to one another as shown, for example, in FIG. 2. The rotation-blocking panel 31P included in first rotation blocker 31 has a slight negative draft angle to make lock engagement with stop face 220 of compliant arm 22 more robust in illustrative embodiments. The upwardly facing raised surface 31R provided on first rotation blocker 31 provides no ramping or camming function in the illustrated embodiment. Similarly, the upwardly facing raised surface 32R provided on second rotation blocker 32 provides no ramping or camming function in the illustrated embodiment.

Compliant arm 22 has a root end 22R coupled to exterior side wall 14S of closure 14 and an opposite free end 22F that is arranged normally to be separated from exterior side wall 14S of closure 14 as suggested in FIGS. 2, 9, and 10. Compliant arm 22 is substantially L-shaped and comprises a short segment defining a strip-support base 22B and a relatively longer segment defining a deflectable strip 22S and including stop face 220.

In the illustrative embodiment, the length of the relatively short strip-support base 22B is less than the spacial distance provided between free end 22F of compliant arm 22 and exterior side wall 14S owing to a non-tangential angled orientation of deflectable strip 22S relative to annular exterior side wall 14S as suggested in FIGS. 9 and 11. When free end 22F of compliant arm 22 is moved radially inwardly toward exterior side wall 14S of closure, a load is applied to compliant arm 22 since compliant arm 22 is made of a resilient, flexible, plastics material. Once that load is released, the springy compliant arm 22 will snap back to assume its original position relative to closure 14.

Arm-return spring 24 is a relatively short curved segment as shown in FIG. 9. Arm-return spring 24 includes an inner end 241 coupled to exterior side wall 14S of closure 14 and an outer end 24O coupled to free end 22F of compliant arm 22.

Closure-removal inhibitor 20 is coupled to exterior side wall 14S of closure 14 as shown in FIG. 9 Arm-return spring 24 is curved in a natural pre-loaded state. Compliant arm 22 includes a strip-support base 22B cantilevered to exterior side wall 14S of closure 14 and a deflectable strip 22S coupled to strip-support base 22B and configured to include a free end 22F having a radially inner portion 221 coupled to an outer end 24O of the curved arm-return spring 24 and a radially outer portion 22O configured to provide a stop face 22O.

Stop face 22O of compliant arm 22 is arranged to face toward a substantially vertical rotation-blocking panel 31P of the first rotation blocker 31 as suggested in FIG. 10 so that the stop face 22O will engage the stationary rotation-blocking panel 31P during counterclockwise rotation of closure 14 relative to container 12 to block further rotation of closure 14 about a vertical closure-rotation axis 14A in a counterclockwise closure-removal direction 102. This inhibits removal of closure 14 from container adapter 12A until deflectable strip 22S of compliant arm 22 has been moved radially inwardly toward closure 14 by a user to compress arm-return spring 24 and cause compliant arm 22 to flex and move toward and alongside the exterior side wall 14S of closure 14 as suggested in FIG. 12 so as to move the stop face 22O of compliant arm 22 into and through the first arm-passage space 131 to avoid contact with the stationary first rotation blocker 31 and allow continued rotation of closure 14 in the counterclockwise closure-removal direction 102.

A top plan view of the child-resistant package 10 of FIG. 1 during installation of the rotatable closure 14 on the underlying container adapter 12A is provided in FIG. 11. At this stage of installation, closure 14 has been rotated on the threaded filler neck 121 of container adapter 12A in a clockwise closure-installation direction 101 to position strip-support base 22B of compliant arm 22 to lie in a downstream position aligned with and facing toward the first arm-passage space 131 provided between first rotation blocker 31and the exterior side wall 14S of closure 14. The leading strip-support base 22B is narrow enough to pass through the first arm-passage space 131 during rotation of closure 14 about the closure-rotation axis 14A in the clockwise closure-installation direction 101.

A radially inwardly facing portion 311 of the stationary first rotation blocker 31 has engaged an outwardly facing elongated cam-follower ridge 22R included in the deflectable strip 22S to cause deflectable strip 22S to be moved toward and alongside the exterior side wall 14S of closure 14 during continued rotation of closure 14 in the clockwise closure-installation direction 101 so that compliant arm 22 is arranged to pass through the first arm-passage space 131 provided between first rotation blocker 31 and the exterior side wall 14S of closure 14. Also, the arm-return spring 24 coupled to the closure and to the deflectable strip 22S is compressed to lie closer to the exterior side wall 14S of closure 14 during such passage.

In a next stage of closure installation, closure 14 has been rotated still further in the clockwise closure-installation direction 101 to assume an installed container-closing position as shown in FIG. 13. Now, the stop face 22O provided on the free end 22F of compliant arm 22 is positioned to lie in spaced-apart relation to the rotation-blocking panel 31P provided on the upstanding stationary first rotation blocker 31.

In a first stage of closure removal shown in FIG. 14, some rotation of the closure in a counterclockwise closure-removal direction 102 has taken place to cause the stop face 22O provided on free end 22F of compliant arm 22 of closure-removal inhibitor 20 to lie in closely confronting relation to the rotation-blocking panel 31P provided on the upstanding stationary first rotation blocker 31. As such, any further rotation of closure 14 relative to container adapter 12A in the counterclockwise closure-removal direction 102 will be blocked by engagement of the moving stop face 22O and the stationary rotation-blocking panel 31P to block removal of closure 14 from container adapter 12A unless a radially inwardly directed PUSH force F (shown in phantom) is applied by a knowledgeable user to a radially outwardly facing surface 22P of compliant arm 22 to cause the compliant arm 22 and the arm-return spring 24 to move radially inwardly in tandem toward the exterior side wall 14S of closure 14 to assume compressed positions associated with the rotation-allowing compressed mode of the closure-removal inhibitor 20 shown in FIG. 12 so that continued rotation of closure 14 about the vertical closure-rotation axis 14A in the counterclockwise closure-removal direction 102 will lead to removal of closure 14 from container adapter 12A. The compliant arm 22 is normally arranged to position stop face 22O so that it always catches on the rotation-blocking panel 31P of stationary first rotation blocker 31 and holds closure-removal inhibitor 20 from passing through arm-passage space 131 and by first rotation blocker 31 until compliant arm 22 is pushed inwardly to compress arm-return spring 24 and slim-down the width of closure-removal inhibitor 20.

Figure 8:
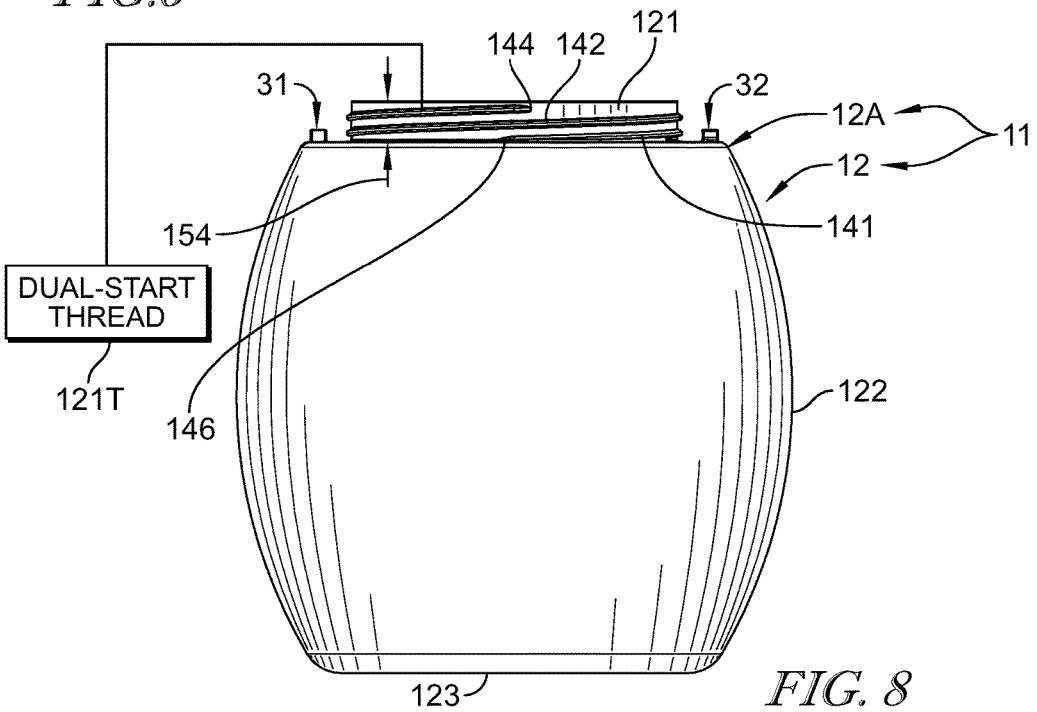
FIG. 8 is a reduced side elevation view of the container of FIGS. 1-4.

In accordance with the present disclosure, an external dual-start thread 121T is provided on filler neck 121 of container adapter 12A as suggested diagrammatically in FIGS. 4 and 8. This allows closure 14 to be applied and locked more quickly than a single-start thread design. For example, closure 14 is applied and locked with about one half (i.e. about 180 degrees) of rotation in the clockwise closure-installation direction 101.

External dual-start thread 121T includes a first thread 141 and a second thread 142. Each of first thread 141 and second thread 142 have a first leading end 144 and a first trailing end 146 as suggested in FIG. 8. First leading end 144 is located between side wall 122 and closure 14. First trailing end 146 is located between first leading end 144 and closure 12 as shown in FIG. 8. Each first leading end 144 is located in spaced-apart circumferential relation to both rotation blockers 31, 32 as shown in FIG. 8. Said another way, each starting end is spaced apart from both rotation blockers about 90 degrees as shown in FIG. 8. As a result, 180 degrees of closure rotation causes each closure removal inhibitor 20 to rotate past an associated rotation blocker 31, 32 during installation of closure 14.

External dual-start thread system 121T is coupled to an exterior surface of the endless side wall of the upwardly extending filler neck 121 and arranged to mate with closure 12 to retain closure 12 in a mouth-closing position on upwardly extending filler neck 121 of container adapter 12A. External dual-start thread system 121T includes first thread 141 and second thread 142. First thread 141 is arranged to wind around the endless side wall and has a first leading end 144 arranged to lie at a first distance from top rim 120 and offset from the first rotation blocker 31 by a first angle 155 a first trailing end 146 arranged to lie at a relatively greater second distance from top rim 120. Second thread 142 is arranged to wind around the endless side wall in an interleaved pattern relative to first thread 141 and has a second leading end arrange to lie at a third distance from the top rim 120 and offset from the second rotation blocker 32 by a second angle 156 and offset from the first rotation blocker 31 by a third angle 157 as suggested in FIG. 15A.

In one example, the first angle 155 is about 80 degrees to about 90 degrees, the second angle 156 is about 80 degrees to about 90 degrees, and the third angle 157 is about 260 degrees to about 270 degrees. In another example, the first angle 155 is about 90 degrees, the second angle 156 is about 90 degrees, and the third angle 157 is about 270 degrees. In another example, first and second angles may 70 degrees and the third angle may be about 250 degrees, second, and third angles may be any suitable combination of angle. In yet another example, first, second, and third angles may be any suitable combination of angles. In one example, the angles should be selected such that multi-mode closure-removal inhibitor 20 passes by one of first and second rotation blockers 31, 32 during installation of closure 12 on container 12 during the 180 degrees of closure rotation.

This dual-start thread 121T provides proper thread engagement to close and seal vessel 11 as needed particularly when the stored product is not moisture or air sensitive. Dual-start thread 121T may be useful when closure 14 is relatively wide and relatively thin as suggested in FIG. 8. Thus, in accordance with the present disclosure, two rotation blockers 31, 32 are included so that there are two opportunities to engage the closure-removal inhibitor 20 when closure 14 is installed from any starting position on container 12.

Containers 12, 12', 12" may be used, for example, to store detergent pods in product-storage chamber 16 formed therein. In the detergent-pod example, mouth 15 of container 12, 12', and 12" is sized to allow a hand of a user to pass there through and remove a detergent pod stored in product-storage chamber 16. As a result, container 12 and mouth 15 may be sized to accommodate this use.

Container 12, for example, has a filler-neck diameter 148 as shown in FIG. 4. Filler-neck diameter 148 is, for example, the diameter as measured to an outer surface of filler neck 121. In one example, filler-neck diameter 148 may be in a range of about 2.3 inches to about 4.2 inches. In another example, filler-neck diameter 148 may be in a range of about 2.256 inches to about 4.216 inches. In another example, filler-neck diameter 148 may be about 2.256 inches. In another example, filler-neck diameter 148 may be about 4.216 inches.

Container 12, for example, has a thread diameter 152 as shown in FIG. 4. Thread diameter 152 is, for example, the diameter as measured to an outer edge of threads 141, 142. In one example, thread diameter 152 may be in a range of about 2.4 inches to about 4.4 inches. In another example, thread diameter 152 may be in a range of about 2.35 inches to about 4.34 inches. In another example, thread diameter 152 may be about 2.35 inches. In another example, thread diameter 152 may be about 4.34 inches.

Container 12, for example, has a filler-neck height 154 as shown in FIG. 8. Filler-neck height 154 is, for example, the height of filler neck 121 above top rim 120. In one example, a filler-neck height 154 may be in a range of about 0.4 inches to about 0.7 inches. In another example, a filler-neck height 154 may be in a range of about 0.48 inches to about 0.647 inches. In another example, a filler-neck height 154 may be about 0.480 inches. In another example, a filler-neck height 154 may be about 0.647 inches.

Figure 5:
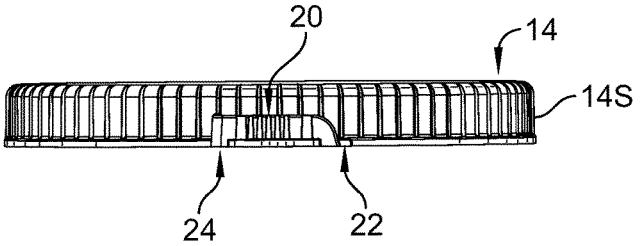
FIG. 5 is an enlarged side elevation view of the closure of FIGS. 1-4.
Figure 6:
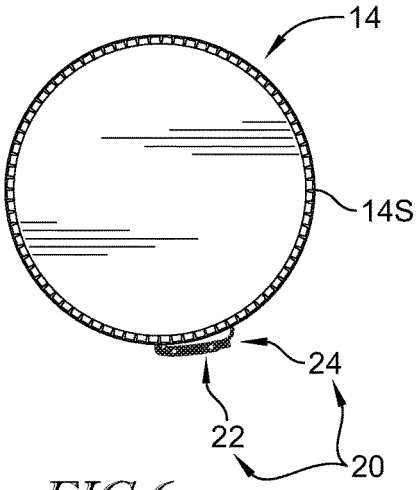
FIG. 6 is a reduced top plan view of the closure of FIG. 5 showing that the root end of the compliant arm is coupled to the exterior side wall of the closure and the free end of the compliant arm is separated from the exterior side wall of the closure.
Figure 7:
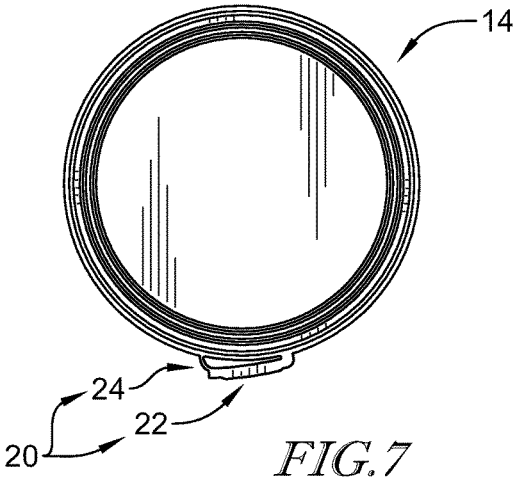
FIG. 7 is a reduced bottom view of the closure of FIG. 5.

Container 12, for example, has a container diameter 150 as shown in FIG. 5. Container diameter 150 is, for example, the largest diameter of the container measured to an outer surface of the container. In one example, container diameter 150 is greater than thread diameter 152. Container 12 may be referred to as a wide-mouth container due to the relationship between container diameter 150, filler-neck diameter 148, thread diameter 152, and filler-neck height 154.

Container diameter 150 is, for example, the largest diameter of the container measured to an outer surface of the container. In one example, container diameter 150 is greater than thread diameter 152. Container 12 may be referred to as a wide-mouth container due to the relationship between container diameter 150, filler-neck diameter 148, thread diameter 152, and filler-neck height 154.

Container 12', for example, has a container width 12'W and a container length 12'L as shown in FIG. 15A. In another example, container 12" has a container width 12"W as shown in FIG. 18. Filler-neck diameter 148, thread diameter 152, and filler-neck height 154 in accordance with the present disclosure may be used with containers 12' and 12". Containers 12' and 12" may be referred to as a wide-mouth container due to the relationship between dimensions of the container, filler-neck diameter 148, thread diameter 152, and filler-neck height 154.

In one illustrative example, containers in accordance with the present disclosure may have a filler-neck diameter to container diameter ratio of greater than 0.5. Furthermore, containers in accordance with the present disclosure may have a filler-neck diameter to largest container dimension ratio as measured in a horizontal plane of greater than about 0.5. Container 12, for example, has a filler-neck diameter to container diameter ratio of about 0.6. Container 12', for example, has a filler-neck diameter to container length ratio of about 0.5. Container 12', for example, has a filler-neck diameter to container width ratio of about 0.9. Container 12", for example, has a filler-neck diameter to container width ratio of 0.5. Container 12", for example, has a filler-neck diameter to container width ratio of 0.6. In these examples, one factor used to determine the mouth diameter is that the diameter is of sufficient size to allow a user's hand to pass there through and remove product stored in product-storage chamber 16 or allow large products, such as detergent pods, to pass through mouth 15.

The invention claimed is:

1. A child-resistant package comprising a vessel including a container formed to include a product-storage chamber and a separate container adapter mated to the container and arranged to define an upper boundary of the product-storage chamber, the container adapter including a top rim coupled to the container and an upwardly extending filler neck having a root end appended to the top rim and a free end arranged to lie in spaced-apart relation to the root end to define an endless side wall extending therebetween and defining a mouth opening into the product-storage chamber, a closure configured to surround and cooperate with the upwardly extending filler neck of the container adapter to close the mouth defined by the endless side wall, a child-resistant closure-release control mechanism including stationary first and second rotation blockers coupled to the top rim of the container and arranged to lie in spaced-apart relation to one another and a multi-mode closure-rotation inhibitor coupled to the closure to rotate therewith relative to the top rim during closure installation and removal from the container adapter, and an external dual-start thread system coupled to an exterior surface of the endless side wall of the upwardly extending filler neck and arranged to mate with the closure to retain the closure in a mouth-closing position on the upwardly extending filler neck of the container adapter, the external dual-start thread system including a first thread arranged to wind around the endless side wall and having a first leading end arranged to lie at a first distance from the top rim and a first trailing end arranged to lie at a relatively greater second distance from the top rim and a second thread arranged to wind around the endless side wall in an interleaved pattern relative to the first thread and having a second leading end arranged to lie at a third distance from the top rim and a second trailing end arranged to lie at a fourth distance above the top rim, wherein the closure-rotation inhibitor is arranged to be shifted relative to the endless side wall of the upwardly extending filler neck of the container adapter automatically during closure installation and manually during closure removal between a rotation-blocking expanded mode away from the endless side wall and a rotation-allowing compressed mode relatively nearer to the endless side wall, in the rotation-blocking expanded mode, the closure-rotation inhibitor will rotate along with the closure about a central vertical axis of rotation of the closure to engage one of the stationary first and second rotation blockers after rotation of the closure following engagement of the closure with a companion one of the first and second leading ends of the threads to block further rotation of the closure relative to the container adapter, and in the rotation-allowing compressed mode, the closure-rotation inhibitor has changed shape to assume a slimmed-down shape that is sized to pass through a space provided between one of the first and second rotation blockers and the endless side wall of the upstanding filler neck without engaging said one of the first and second rotation blockers so that further rotation of the closure relative to the container adapter is allowed leading to removal of the closure from the container adapter.

2. The child-resistant package of claim 1, wherein the closure-rotation inhibitor comprises an L-shaped compliant arm having a root end coupled to the closure and a relatively short curved arm-return spring arranged to interconnect the closure a free end of the L-shaped compliant arm.

3. The child-resistant package of claim 2, wherein the L-shaped compliant arm comprises a short segment defining a strip-support base and a relatively longer segment coupled to the short segment an elbow joint and arranged to cooperate with the short segment to define an inclined angle there between of about 90 degrees when the closure-rotation inhibitor is in the rotation-blocking expanded mode, the strip support base includes a stop face located at the free end of the L-shaped compliant arm and arranged to face toward and mate with a confronting rotation-blocking panel included in the first rotation blocker to block further rotation of the closure in a counter-clockwise closure removal direction so that a user is unable to rotate the closure about the central vertical axis of rotation sufficiently to separate the closure from the upwardly extending filler neck during removal of the closure from the container adapter, and the elbow joint is untethered from the endless side wall of the upwardly extending filler neck by any structure other than the short segment.

4. The child-resistant package of claim 3, wherein the rotation-blocking panel included in the first rotation blocker has a slight negative draft angle to maximize locking engagement with the stop face of the relatively longer segment of the L-shaped compliant arm.

5. The child-resistant package of claim 4, wherein the filler neck of the container has a filler-neck diameter, the container has a container dimension which is the largest dimension of the container measured in a horizontal plane, the central axis extends through the horizontal plane and is normal to the horizontal plane, and a ratio of the filler-neck diameter to the container dimension is greater than 0.5.

6. The child-resistant package of claim 4, wherein the filler neck of the container has a filler-neck diameter, the container has a container dimension which is the largest dimension of the container measured in a horizontal plane, the central axis extends through the horizontal plane and is normal to the horizontal plane, and a ratio of the filler-neck diameter to the container dimension is greater than 0.5 and less than about 1.

7. The child-resistant package of claim 1, wherein the filler neck of the container has a filler-neck diameter, the container has a container dimension which is the largest dimension of the container measured in a horizontal plane, the central axis extends through the horizontal plane and is normal to the horizontal plane, and a ratio of the filler-neck diameter to the container dimension is greater than 0.5.

8. The child-resistant package of claim 7, wherein the ratio is less than about 1.

9. The child-resistant package of claim 1, wherein the first distance from the top rim and the third distance from the top rim are approximately the same.

10. The child-resistant package of claim 1, wherein the second distance from the top rim and the fourth distance from the top rim are approximately the same.

11. A child-resistant package comprising a vessel including a container formed to include a product-storage chamber and a separate container adapter mated to the container and arranged to define an upper boundary of the product-storage chamber, the container adapter including a top rim coupled to the container and an upwardly extending filler neck having a root end appended to the top rim and a free end arranged to lie in spaced-apart relation to the root end to define an endless side wall extending therebetween and defining a mouth opening into the product-storage chamber, a closure configured to surround and cooperate with the upwardly extending filler neck of the container adapter to close the mouth defined by the endless side wall, a child-resistant closure-release control mechanism including stationary first and second rotation blockers coupled to the top rim of the container and arranged to lie in spaced-apart relation to one another and a multi-mode closure-rotation inhibitor coupled to the closure to rotate therewith relative to the top rim during closure installation and removal from the container adapter, and an external thread system coupled to an exterior surface of the endless side wall of the upwardly extending filler neck and arranged to mate with the closure to retain the closure in a mouth-closing position on the upwardly extending filler neck of the container adapter, the external thread system including a first thread arranged to wind around the endless side wall and having a first leading end arranged to lie at a first distance from the top rim and a first trailing end arranged to lie at a relatively greater second distance from the top rim, wherein the closure-rotation inhibitor is arranged to be shifted relative to the endless side wall of the upwardly extending filler neck of the container adapter automatically during closure installation and manually during closure removal between a rotation-blocking expanded mode away from the endless side wall and a rotation-allowing compressed mode relatively nearer to the endless side wall, in the rotation-blocking expanded mode, the closure-rotation inhibitor will rotate along with the closure about a central vertical axis of rotation of the closure to engage one of the stationary first and second rotation blockers after rotation of the closure following engagement of the closure with the leading end of the thread to block further rotation of the closure relative to the container adapter, and in the rotation-allowing compressed mode, the closure-rotation inhibitor has changed shape to assume a slimmed-down shape that is sized to pass through a space provided between one of the first and second rotation blockers and the endless side wall of the upstanding filler neck without engaging said one of the first and second rotation blockers so that further rotation of the closure relative to the container adapter is allowed leading to removal of the closure from the container adapter.

12. The child-resistant package of claim 11, wherein the closure-rotation inhibitor comprises an L-shaped compliant arm having a root end coupled to the closure and a relatively short curved arm-return spring arranged to interconnect the closure a free end of the L-shaped compliant arm.

13. The child-resistant package of claim 12, wherein the L-shaped compliant arm comprises a short segment defining a strip-support base and a relatively longer segment coupled to the short segment an elbow joint and arranged to cooperate with the short segment to define an inclined angle there between of about 90 degrees when the closure-rotation inhibitor is in the rotation-blocking expanded mode, the strip support base includes a stop face located at the free end of the L-shaped compliant arm and arranged to face toward and mate with a confronting rotation-blocking panel included in the first rotation blocker to block further rotation of the closure in a counter-clockwise closure removal direction so that a user is unable to rotate the closure about the central vertical axis of rotation sufficiently to separate the closure from the upwardly extending filler neck during removal of the closure from the container adapter, and the elbow joint is untethered from the endless side wall of the upwardly extending filler neck by any structure other than the short segment.

14. The child-resistant package of claim 13, wherein the rotation-blocking panel included in the first rotation blocker has a slight negative draft angle to maximize locking engagement with the stop face of the relatively longer segment of the L-shaped compliant arm.

15. The child-resistant package of claim 14, wherein the filler neck of the container has a filler-neck diameter, the container has a container dimension which is the largest dimension of the container measured in a horizontal plane, the central axis extends through the horizontal plane and is normal to the horizontal plane, and a ratio of the filler-neck diameter to the container dimension is greater than 0.5.

16. The child-resistant package of claim 14, wherein the filler neck of the container has a filler-neck diameter, the container has a container dimension which is the largest dimension of the container measured in a horizontal plane, the central axis extends through the horizontal plane and is normal to the horizontal plane, and a ratio of the filler-neck diameter to the container dimension is greater than 0.5 and less than about 1.

17. The child-resistant package of claim 11, wherein the filler neck of the container has a filler-neck diameter, the container has a container dimension which is the largest dimension of the container measured in a horizontal plane, the central axis extends through the horizontal plane and is normal to the horizontal plane, and a ratio of the filler-neck diameter to the container dimension is greater than 0.5.

18. The child-resistant package of claim 17, wherein the ratio is less than about 1.

19. The child-resistant package of claim 11, wherein the first distance from the top rim and the third distance from the top rim are approximately the same.

20. The child-resistant package of claim 11, wherein the second distance from the top rim and the fourth distance from the top rim are approximately the same.

* * * * *